US007389060B2

(12) United States Patent
Ishibashi

(10) Patent No.: US 7,389,060 B2
(45) Date of Patent: Jun. 17, 2008

(54) IMAGE FORMING APPARATUS FOR CONTROLLING VARIATION OF IMAGE DENSITY AND TONER CONCENTRATION

(75) Inventor: Mikio Ishibashi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 241 days.

(21) Appl. No.: 11/408,081

(22) Filed: Apr. 21, 2006

(65) Prior Publication Data

US 2006/0239701 A1 Oct. 26, 2006

(30) Foreign Application Priority Data

Apr. 22, 2005 (JP) ..... 2005-125793

(51) Int. Cl.
*G03G 15/08* (2006.01)

(52) U.S. Cl. ..... 399/30; 399/49; 399/62

(58) Field of Classification Search ..... 399/27, 399/29, 30, 49, 58, 59, 60, 61, 62, 111
See application file for complete search history.

(56) References Cited

U.S. PATENT DOCUMENTS

| | | | | |
|---|---|---|---|---|
| 5,245,389 | A * | 9/1993 | Yoshiyama et al. | 399/43 |
| 5,410,388 | A * | 4/1995 | Pacer et al. | 399/49 |
| 6,181,888 | B1 * | 1/2001 | Scheuer et al. | 399/49 |
| RE37,859 | E * | 9/2002 | Lior et al. | 399/57 |
| 6,509,918 | B1 * | 1/2003 | Akichika et al. | 347/141 |
| 7,024,126 | B2 * | 4/2006 | Kellie et al. | 399/57 |
| 2006/0239701 | A1 | 10/2006 | Ishibashi | |

FOREIGN PATENT DOCUMENTS

| | | |
|---|---|---|
| JP | 2002-258596 | 9/2002 |
| JP | 2003-076078 | 3/2003 |
| JP | 2003-131443 | 5/2003 |
| JP | 2004-004394 | 1/2004 |
| JP | 2004-004919 | 1/2004 |
| JP | 2004-109547 | 4/2004 |
| JP | 2004-226868 | 8/2004 |
| JP | 2004-233735 | 8/2004 |
| JP | 2004-243652 | 9/2004 |

OTHER PUBLICATIONS

U.S. Appl. No. 11/925,266, filed Oct. 26, 2007, Koinuma et al.

* cited by examiner

*Primary Examiner*—Hoan H Tran
(74) *Attorney, Agent, or Firm*—Oblon, Spivak, McClelland, Maier & Neustadt, P.C.

(57) ABSTRACT

An image forming apparatus includes an image carrying member, a developing unit, an image density detector, a toner concentration detector, a toner concentration controller, and an output adjustment unit. The image carrying member forms a reference latent image pattern. The developing unit develops the reference latent image pattern as a reference image pattern with a two-component developer. The image density detector detects an image density of the reference image pattern. The toner concentration detector detects a toner concentration in the two-component developer. The toner concentration controller controls the toner concentration based on the image density detected by the image density detector. The output adjustment unit adjusts a toner concentration sensing level of the toner concentration detector with a sensor control voltage. The toner concentration is controlled by a target voltage with reference to the image density. The toner concentration range is changed by changing the sensor control voltage.

6 Claims, 12 Drawing Sheets

FIG. 4

| TABLE NO | DEVELOP BIAS VOLTAGE (V) | CHARGE BIAS VOLTAGE (V) | TRANSFER VOLTAGE (μA) | LASER DIODE POWER |
|---|---|---|---|---|
| 0 | −300 | −500 | 5.0 | 255/255 |
| 1 | −320 | −520 | 5.2 | 250/255 |
| 2 | −340 | −540 | 5.4 | 245/255 |
| 3 | −360 | −560 | 5.6 | 240/255 |
| 4 | −380 | −580 | 5.8 | 235/255 |
| 5 | −400 | −600 | 6.0 | 230/255 |
| 6 | −420 | −620 | 6.2 | 220/255 |
| 7 | −440 | −640 | 6.4 | 215/255 |
| 8 | −460 | −660 | 6.6 | 210/255 |
| 9 | −480 | −680 | 6.8 | 205/255 |
| 10 | −500 | −700 | 7.0 | 200/255 |
| 11 | −520 | −720 | 7.2 | 195/255 |
| 12 | −540 | −740 | 7.4 | 190/255 |
| 13 | −560 | −760 | 7.6 | 185/255 |
| 14 | −580 | −780 | 7.8 | 180/255 |
| 15 | −600 | −800 | 8.0 | 175/255 |

IMAGE FORMING APPARATUS FOR CONTROLLING VARIATION OF IMAGE DENSITY AND TONER CONCENTRATION

CROSS-REFERENCE TO RELATED APPLICATIONS

This application claims priority from Japanese patent application No. 2005-125793, filed Apr. 22, 2005, the entire contents of which are incorporated herein by reference.

BACKGROUND OF THE INVENTION

1. Field of the Invention

The present disclosure generally relates to an image forming apparatus having an image density detector and a toner concentration detector, and more particularly to an image forming apparatus which adjusts a image density and toner concentration with an image density detector and toner concentration detector.

2. Discussion of the Background

An image forming apparatus includes a photoconductive member, a charger to charge the photoconductive member, an optical writing unit to write a latent image on the charged photoconductive member, a developing unit to develop the latent image formed on the photoconductive member as a toner image with an effect of developing bias voltage, and a transfer unit to transfer the toner image formed on the photoconductive member to a recording sheet.

Such image forming apparatus may further include a toner amount detector, which can be used to detect a relationship between the developing bias voltage and toner amount, and a controller, which controls conditions of the charger, optical writing unit, developing unit, and transfer unit based on a result detected by the toner amount detector.

In such image forming apparatus, the relationship between the developing bias voltage and toner amount can be expressed by a linear function based on information detected by the toner amount detector.

The image forming apparatus may further include a condition storing unit, which stores a plurality of patterns of controlling parameters consisting of parameters for a charger, optical writing unit, developing unit, and transfer unit in advance. Based on the developing bias voltage, the controller can select a pattern of controlling parameters from the condition storing unit, and control the charger, optical writing unit, developing unit, and transfer unit with the controlling parameters selected from the condition storing unit.

In such an image forming apparatus, a two component developer, having toners and carriers, may be used in the developing unit to develop an image on a recording sheet (e.g., transfer sheet).

If an image area ratio produced on the recording sheet becomes smaller, a toner amount to be adhered on the recording sheet becomes smaller, wherein the image area is an area where toner actually adheres on the recording sheet.

If an image area ratio produced on the recording sheet becomes smaller, a frequency of refilling fresh toners in the developing unit may become smaller. Accordingly, a ratio of toners that remain in the developing unit for a longer time becomes greater and such toners may have received an agitation effect of a screw with a longer time, wherein the screw is provided in the developing unit to constantly agitate and transport toner in the developing unit.

Accordingly, a charging potential of such toners may increase, and thereby a toner amount to be adhered on the recording sheet may become smaller because of an imbalance between a latent image potential on the photoconductive member (i.e., image carrying member) and the charging potential of such toners.

Such condition may downgrade a developability of toner, so that an image density on the recording sheet may become lower. In order to compensate for such lower developability of the toner, fresh toners may be refilled into the developing unit, by which a toner ratio against carriers may increase in the developing unit. Accordingly, the toner concentration in the developing unit may increase.

If the toner concentration has increased beyond a specified level, unpreferable phenomenon, such as toner scattering and fogging, may occur. Such unpreferable phenomenon may be suppressed by setting a range for toner concentration.

However, even if the toner concentration in the developing unit is maintained within a predetermined range, a change of developer condition may downgrade a developability of the developer. If the developability of the developer downgrades, an image having lower density may be produced on the recording sheet.

When images of smaller image area are printed continuously with lower image density, the image forming apparatus may control the image density to a preferable level with less emphasis on toner concentration. In this case, the toner concentration may unfavorably exceed the range set for the toner concentration.

In another case, when images of smaller image area are printed continuously with lower image density, the image forming apparatus may control the toner concentration to a preferable level with less emphasis on the image density. In this case, an image density may become unfavorably lower.

FIG. 1 is a schematic view of a conventional image forming apparatus 100, which can be used as a printer, for example. The image forming apparatus 100 includes a photoconductive member 1, a charge roller 2, a laser diode unit 3, a developing roller 4, a transfer unit 5, a transport belt 6, a fixing unit 7, a density sensor 8, and a controller 10, as shown in FIG. 1.

The photoconductive member 1 serving as an image carrying member forms an electrostatic latent image and a toner image corresponding to the electrostatic latent image on its surface, as discussed below.

The charge roller 2 charges the surface of the photoconductive member 1. The laser diode unit 3 irradiates a light beam to the charged surface of the photoconductive member 1 to write the electrostatic latent image on the photoconductive member 1. The developing roller 4 develops the electrostatic latent image on the photoconductive member 1 as the toner image by adhering toner on the electrostatic latent image. The electrostatic latent image is developed as the toner image by using a potential difference between a developing bias voltage and the electrostatic latent image potential.

The transfer unit 5 transfers the toner image from the photoconductive member 1 to a recording sheet at a transfer position (i.e., nip position). The transport belt 6 transports the recording sheet to the transfer position (i.e., nip position) and fixing position. The fixing unit 7 fixes the toner image on the recording sheet. After the toner image is fixed on the recording sheet by the fixing unit 7, the recording sheet is transported to an ejection port (not shown), and ejected to an outside of the image forming apparatus 100. The density sensor 8 detects a toner density of a toner image pattern, which is transferred on the recording sheet.

The controller 10 controls the image forming apparatus 100 as a whole. The controller 10 includes a read only memory (ROM) and non-volatile random access memory (NVRAM), for example. The ROM stores controlling parameters such as developing bias voltage, charging bias voltage, transfer bias voltage, and laser diode power, for example.

The image forming apparatus 100 includes a tandem configuration for the photoconductive members 1 for producing magenta, cyan, yellow, and black images. The following processes are repeatedly conducted at each of the photoconductive members 1.

The charge roller 2 charges the photoconductive member 1, and then the laser diode unit 3 writes an electrostatic latent image on the photoconductive member 1 with a light beam. The developing roller 4 develops the electrostatic latent image on the photoconductive member 1 as a toner image, and then the transfer unit 5 transfers the toner image to a recording sheet.

The image forming apparatus 100 conducts an image density adjustment when images are produced on a predetermined number of recording sheets or when the image forming apparatus 100 is activated and warmed up, for example. Such image density adjustment is referred to as process control, hereinafter.

FIG. 2 is a flow chart for explaining an image density adjustment process (i.e., process control) for the image forming apparatus 100.

In step S101, the charge roller 2, developing roller 4, and transfer unit 5 are activated, and a bias voltage is applied to each unit and a motor is activated.

In step S102, a calibration of the density sensor 8 is activated at a predetermined timing.

As shown in FIG. 3, the density sensor 8 includes an infrared LED (light emitting diode) and a phototransistor, wherein a light beam emitted from the infrared LED reflects on a detection face (e.g., recording sheet) and the reflected light beam is received by the phototransistor.

For example, the infrared LED emits a first light beam generated with an electric current of PWM=128(=255/2) to the detection face, wherein PWM is pulse width modulation.

The phototransistor receives light reflected at the detection face and outputs an output signal. A central processing unit (not shown) receives the output signal of the phototransistor.

The calibration of the density sensor 8 is conducted by setting an output signal of the phototransistor, which corresponds to an output signal of a background area (i.e., no image area) of a recording sheet, as discussed below.

If the output signal of the phototransistor for the background area is greater than 4.1V(=4.0+0.1V), for example, the infrared LED emits a second light beam with another electric current of "PWM(2)=PWM(1)−(PWM(1)/2)" to the detection face. Then, the phototransistor receives a light reflected at the detection face (i.e., background area), and outputs another output signal. The central processing unit (not shown) receives the output signal of the phototransistor.

Hereinafter, PWM(n) means an electric current to be supplied to the infrared LED at each "n-th" time of lighting when the infrared LED emits a light beam for each "n-th" time.

For example, PWM(1) means an electric current to be supplied to the infrared LED when the infrared LED emits a first light beam, PWM(2) means an electric current to be supplied to the infrared LED when the infrared LED emits a second light beam after the first light beam, and PWM(3) means an electric current to be supplied to the infrared LED when the infrared LED emits a third light beam after the second light beam.

If the output signal of the phototransistor for background area is smaller than 3.9V(=4.0−0.1V) for the first light beam, the infrared LED emits a second light beam with another electric current of "PWM(2)=PWM(1)+(PWM(1)/2)." The phototransistor receives a light reflected at the detection face, and outputs another output signal. The central processing unit (not shown) receives the output signal of the phototransistor.

If the output signal of the phototransistor for background area is greater than 4.1V(=4.0+0.1V) for the second light beam, the infrared LED emits a third light beam with another electric current of "PWM(3)=PWM(2)−(PWM(1)/4)." The phototransistor receives a light reflected at the detection face (i.e., background area), and outputs another output signal. The central processing unit (not shown) receives the output signal of the phototransistor.

If the output signal of the phototransistor for background area is smaller than 3.9V(=4.0−0.1V) for the second light beam, the infrared LED emits a third light beam with another electric current of "PWM(3)=PWM(2)+(PWM(1)/4)." The phototransistor receives a light reflected at the detection face (i.e., the background area), and outputs another output signal. The central processing unit (not shown) receives the output signal of the phototransistor.

Such adjustment is repeated until the output signal of the phototransistor can be adjusted within a range of 4.0±0.1V for the background area of the recording sheet.

An output signal of the phototransistor, which is received lastly by the central processing unit (not shown) in the above-described process, is set as an electric current value for calibrating the density sensor 8. Such electric current value can be used for calibrating the density sensor 8 until a next new calibration is conducted for the density sensor 8.

After completing the calibration of the density sensor 8, a detection pattern is formed on the photoconductive member 1 to detect an image density of the detection pattern.

The detection pattern may have a rectangular shape having 20 mm in main scanning direction, and 15 mm in sub-scanning direction, for example.

In step S103, a charge bias voltage is set for a detection pattern PN(1). For example, the charge bias voltage for a detection pattern PN(1) is set to −300V. Hereinafter, each of the detection patterns are referred as PN(n), wherein n represents natural numbers.

After setting the charge bias voltage for the detection pattern PN(1), the laser diode unit 3 emits a laser beam to scan the charged photoconductive member 1 with a maximum value of laser diode power (e.g., 255) in step S104 to scan the rectangular pattern (e.g., 20 mm in main scanning direction, and 15 mm in sub-scanning direction).

When the detection pattern PN(1) comes to a position facing the developing roller 4, a developing bias voltage is set for the detection pattern PN(1) (e.g., −100V).

In steps S105 to S108, detection patterns PN(2) to PN(n) are formed on the photoconductive member 1 as similar to PN(1), wherein the detection patterns PN(1) to PN(n) are formed at a predetermined interval (e.g., 10 mm) in sub-scanning direction, for example. For example, n can be set to ten (n=10) to form ten detection patterns on the photoconductive member 1.

The ten detection patterns are applied with a bias voltage (e.g., 10 μA) by the transfer unit 5 at a transfer position to transfer the ten detection patterns to a recording sheet.

The recording sheet having the transferred detection patterns is transported by the transport belt 6, and the image density of the detection patterns are detected by the density sensor 8 in step S109.

The phototransistor (i.e., photosensor) in the density sensor 8 optically receives a light reflected on the recording sheet.

When no toner images is formed on the recording sheet, an output signal (i.e., electric current) of the phototransistor becomes greater, and when a toner image is formed on the recording sheet, an output signal (i.e., electric current) of the phototransistor becomes smaller because of an increased image density of the detection pattern. With such method, an image density on the recording sheet can be detected.

The output signal of the phototransistor is converted to image density data with a conversion equation for output signal/image density, which is stored in a ROM (read only memory). The image density data can be stored in a NVRAM (non-volatile random access memory) in the controller 10.

In such a process, a graph for detection patterns can be plotted with the image density data and the developing bias voltage, in which the vertical axis of the graph represents the image density, and the horizontal axis of the graph represents the developing bias voltage. A relationship of the image density and the developing bias voltage can be collinearly approximated with a least-square method. The gradient of the straight line can be stored in the NVRAM as a developing coefficient.

The controller 10 computes a developing bias voltage Vb from the developing coefficient and a target amount of toner adhesion. The target amount of toner adhesion can be set to 0.6 $mg/cm^2$, for example.

For example, if the developing coefficient is 2.0 ($mg/cm^2/kV$), the developing bias voltage Vb can be computed as $Vb=(1/2.0(mg/cm^2/kV))\times 1000=500V$.

After computing the developing bias voltage Vb, the controller 10 refers the table storing image forming conditions in step S110, wherein the table is stored in the ROM.

In step S110, the controller 10 selects a condition, which is closest to the computed developing bias voltage (e.g., Vb=500V) from the table.

FIG. 4 shows an example table, which stores image forming conditions.

In step S111, a charge bias voltage, developing bias voltage, transfer bias voltage, and laser diode power are determined using the table, and such conditions are stored in the NVRAM (non-volatile random access memory) until a next process control is conducted.

In step S112, the controller 10 completes operations for the process control.

Such process control can be conducted concurrently for a yellow, cyan, magenta, and black toner image by detecting detection patterns formed by each color of toner. Accordingly, process controls for yellow, cyan, magenta, and black toner images are conducted in a parallel manner.

In the image forming apparatus 100, a relationship between the developing bias voltage Vb and a charge voltage Vc needs to be maintained at a predetermined level. Especially, when a two-component developer is used, a value computed by "Vb minus Vc" needs to be maintained at a predetermined level to prevent an adhesion of carriers onto the photoconductive member 1.

A change of the charge voltage Vc may cause a change of adhering capability of toner to the photoconductive member 1, a change of transfer-ability of toner image, and unfavorable image development on the photoconductive member 1 by an excessive transfer bias voltage.

Furthermore, a change of the developing coefficient, developing bias voltage Vb, or charge voltage Vc may cause a change of toner adhering capability to a high-lighted area.

The image forming apparatus 100 can detect a relationship between the toner adhering amount and the developing bias voltage as above-mentioned, by which an image density at a shadow area can be stabilized.

Furthermore, the image forming apparatus 100 can adjust a transfer bias voltage to cope with a change of transfer-ability of toners and unfavorable image development on the photoconductive member 1 by an excessive transfer bias voltage.

Furthermore, the image forming apparatus 100 can stabilize a toner adhering amount to the high-lighted area by using a predetermined laser diode power.

As above described, the image forming apparatus 100 includes an image density detector and a toner amount detector. The image density detector optically detects an image density of detection pattern, formed by a process of forming a latent image and toner image. Based on information detected by the toner amount detector, a toner concentration in the developing unit can be adjusted. With a combination of the image density detector and the toner amount detector, the image forming apparatus 100 may stably produce a higher quality image over time.

However, a toner concentration in the developing unit may increase beyond a specified range if only an output signal of the image density detector (e.g., optical detector) is adjusted within one target range of the image density. Such a drawback may occur depending on conditions and a type of developer to be used in the image forming apparatus 100.

SUMMARY OF THE INVENTION

An embodiment of the present invention relates to an image forming apparatus including an image carrying member, a developing unit, an image density detector, a toner concentration detector, a toner concentration controller, and an output adjustment unit. The image carrying member forms a reference latent image pattern thereon. The developing unit develops the reference latent image pattern as a reference image pattern with a two-component developer having toners and carriers. The image density detector detects an image density of the reference image pattern. The toner concentration detector detects a toner concentration in the two-component developer. The toner concentration controller controls the toner concentration in the two-component developer based on the image density detected by the image density detector. The output adjustment unit adjusts a toner concentration sensing level of the toner concentration detector with a sensor control voltage Vcnt. A toner concentration in the two-component developer is controlled by changing a target voltage Vref with referring the image density detected by the image density detector, wherein the target voltage Vref is set in advance for regulating the toner concentration in the two-component developer and has a voltage range for changing the target voltage Vref. The toner concentration in the two-component developer is controlled in a first toner concentration range having a upper and lower limit by changing the target voltage Vref in the voltage range, and when the toner concentration becomes any one of the upper and lower limit of the first toner concentration range, a second toner concentration range, which is broader than the first toner concentration range, is set for the toner concentration range by changing the sensor control voltage Vcnt so that the toner concentration is controlled in the second toner concentration range.

BRIEF DESCRIPTION OF THE DRAWINGS

A more complete appreciation of the present invention and many of the attendant advantages and features thereof can be readily obtained and understood from the following detailed description with reference to the accompanying drawings, wherein:

FIG. 4 is a schematic table that stores image forming conditions;

DETAILED DESCRIPTION OF THE PREFERRED EMBODIMENTS

Figure 1:
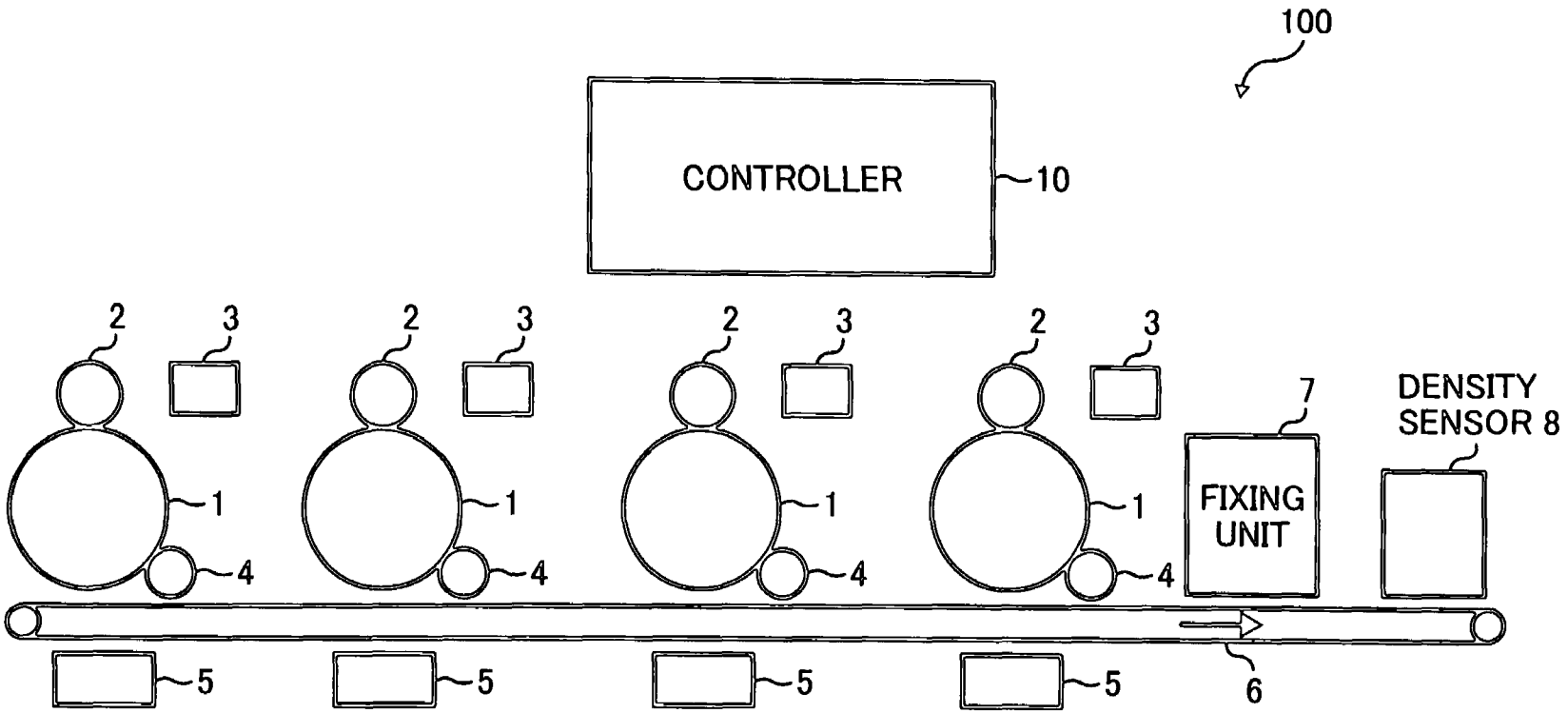
FIG. 1 is a schematic view of a conventional image forming apparatus.
Figure 2:
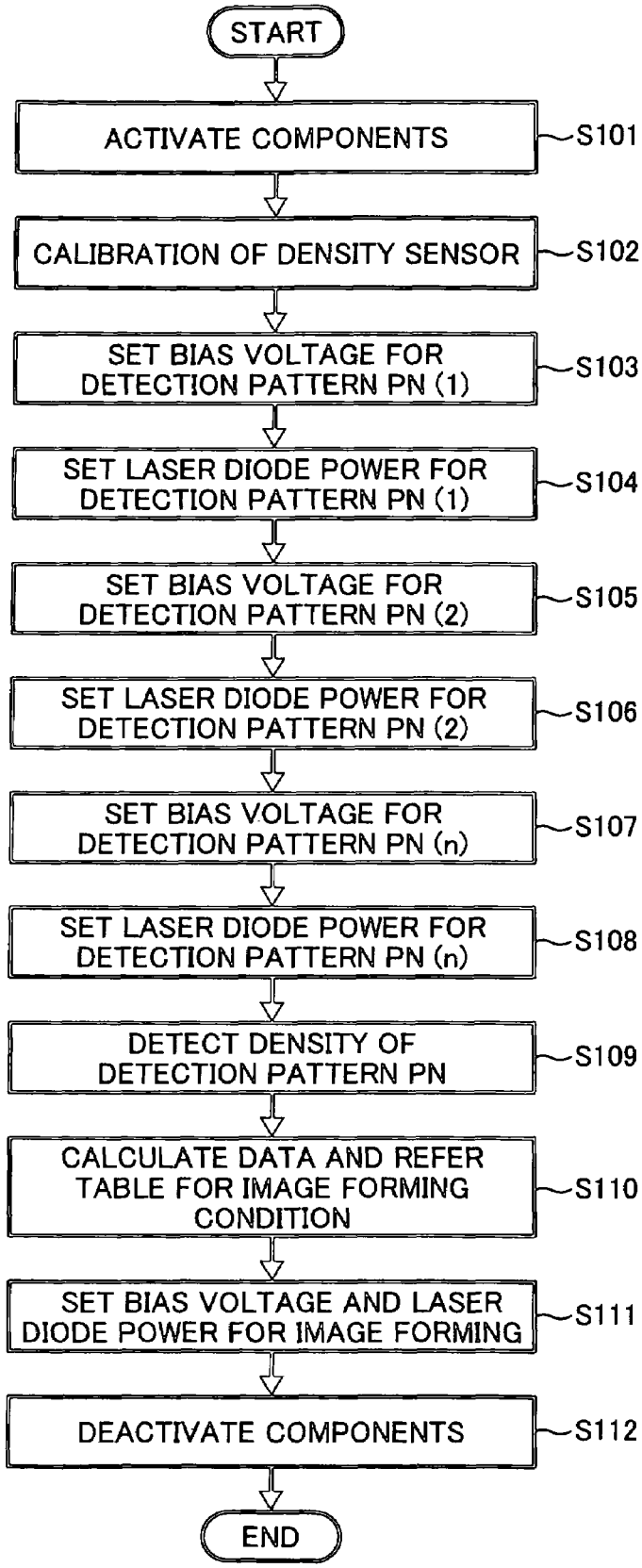
FIG. 2 is a flow chart for explaining an image density adjustment process in an image forming apparatus of FIG. 1.
Figure 3:
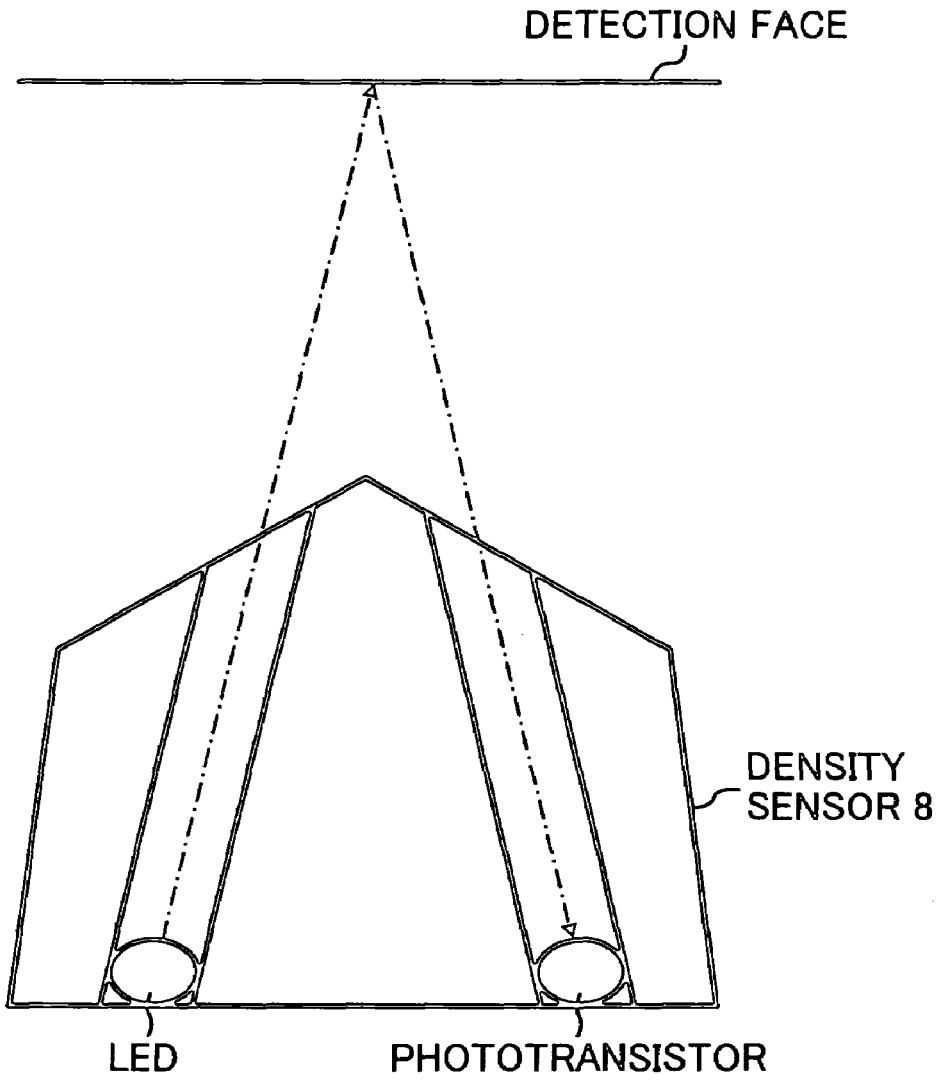
FIG. 3 is a schematic view of an image density sensor.

In describing example embodiments shown in the drawings, specific terminology is employed for the sake of clarity. However, the disclosure of this present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus according to an example embodiment is described with a particular reference to FIGS. 5 to 12.

Figure 5:
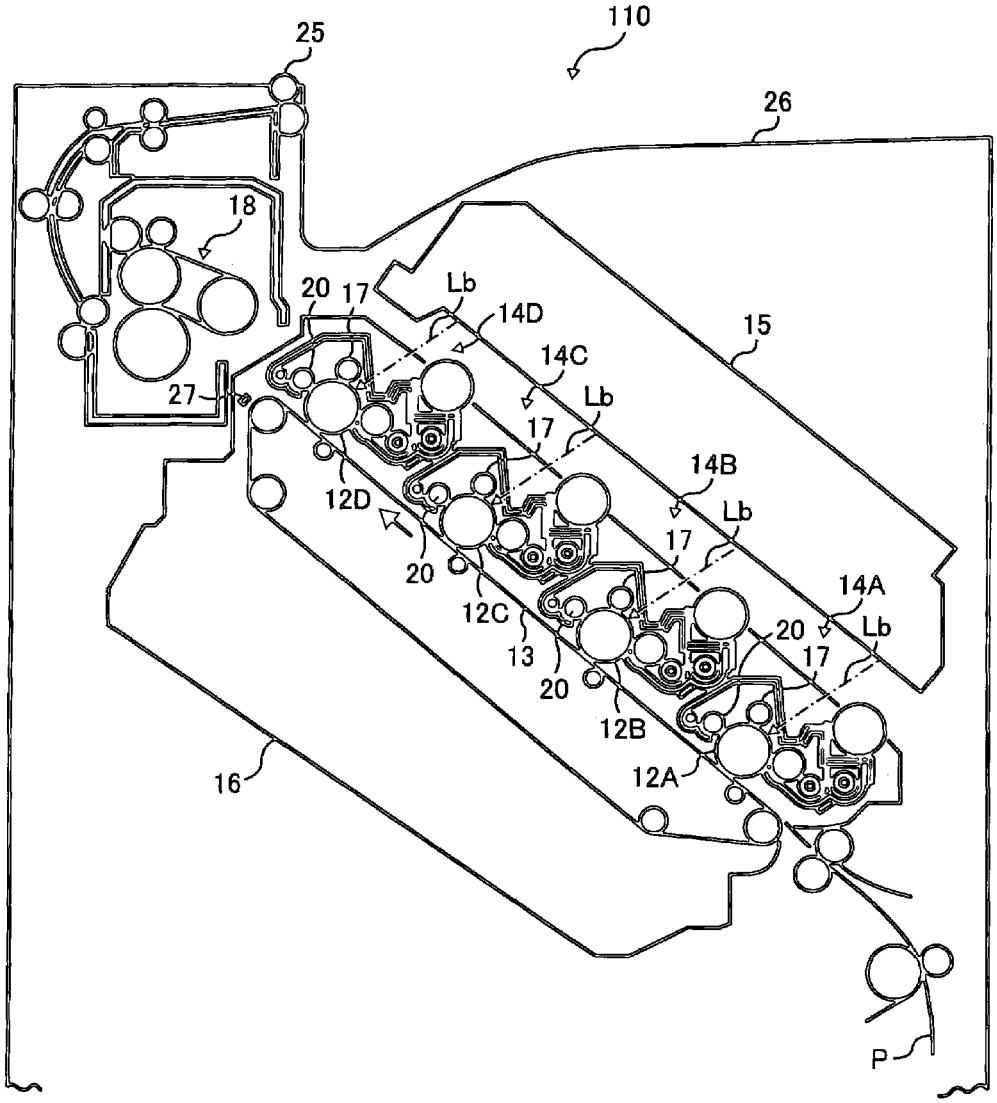
FIG. 5 is a schematic view of a configuration of an image forming apparatus according to an example embodiment, in which a plurality of developing units includes a two-component developer.
Figure 6:
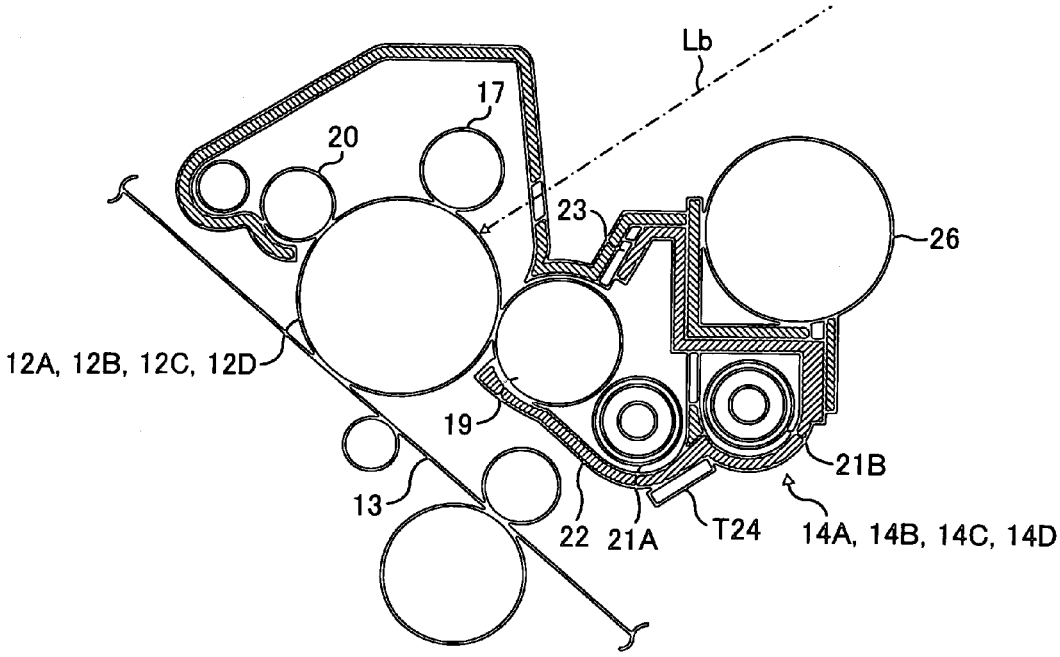
FIG. 6 is a schematic expanded view of a developing unit and a photoconductive member in an image forming apparatus in FIG. 5.

FIG. 5 is a schematic configuration of an image forming apparatus 110 according to an example embodiment, which includes a plurality of developing units having a two-component developer. FIG. 6 is a schematic expanded view of a developing unit and a photoconductive member in the image forming apparatus 110 shown in FIG. 5.

As shown in FIG. 5, the image forming apparatus 110 includes four photoconductive members 12A, 12B, 12C, and 12D in drum shape as image carrying members, a transfer belt 13, an optical writing unit 15, a double face copy unit 16, a charge roller 17, and a fixing unit 18, for example.

The photoconductive members 12A, 12B, 12C, and 12D are arranged from each other at equal intervals. Each of the photoconductive members 12A, 12B, 12C, and 12D contacts an upper face of the transfer belt 13, as shown in FIG. 5.

Each of the photoconductive members 12A, 12B, 12C, and 12D is provided with developing units 14A, 14B, 14C, and 14D, respectively, wherein each of the developing units 14A, 14B, 14C, and 14D includes a different color toner. Each of the developing units 14A, 14B, 14C, and 14D includes a two-component developer, which contains color toner for producing an image from image data. Each of the developing units 14A, 14B, 14C, and 14D develops an image by applying a developing bias voltage.

As shown in FIG. 5, the optical writing unit 15 is provided over the photoconductive members 12A, 12B, 12C, and 12D, and the double face copy unit 16 is provided under the photoconductive members 12A, 12B, 12C, and 12D.

The optical writing unit 15 writes a latent image on the photoconductive members 12A, 12B, 12C, and 12D with a light beam generated from image data. The double face copy unit 16 inverts faces of the recording sheet to form images on both faces of the recording sheet. The charge roller 17 charges the photoconductive members 12A, 12B, 12C, and 12D. The fixing unit 18 fixes a toner image on the recording sheet.

As shown in FIGS. 5 and 6, each of the photoconductive members 12A, 12B, 12C, and 12D includes a cleaning roller 20 to remove toner remaining on the photoconductive members 12A, 12B, 12C, and 12D after transferring a toner image to a recording sheet P.

As shown in FIGS. 5 and 6, each of the photoconductive members 12A, 12B, 12C, and 12D is surrounded by a similar configuration to one another.

The photoconductive member 12A is used for forming a magenta image, the photoconductive member 12B is used for forming a cyan image, the photoconductive member 12C is used for forming a yellow image, and the photoconductive member 12D is used for forming a black image.

The photoconductive members 12A, 12B, 12C, and 12D are arranged in a tandem manner with respect to a transport direction of the recording sheet P, and each of the photoconductive members 12A, 12B, 12C, and 12D transfers a toner image to the recording sheet P at a respective transfer position to form a full color image on the recording sheet P.

The developing units 14A, 14B, 14C, and 14D have a similar configuration to one another, except for the toner color.

As shown in FIG. 6, each of the developing units 14A, 14B, 14C, and 14D includes a developing roller 19 and transport screws 21A and 21B. The developing roller 19 may contact or stand close to the photoconductive members 12A, 12B, 12C, and 12D. The transport screws 21A and 21B, provided in a parallel manner, agitate the developer in the developing units 14A, 14B, 14C, and 14D.

The developing unit 14A uses magenta toner, the developing unit 14B uses cyan toner, the developing unit 14C uses yellow toner, and the developing unit 14D uses black toner, for example.

Each of the developing units 14A, 14B, 14C, and 14D includes a casing 22 having an opening as shown in FIG. 6. The developing roller 19 can be exposed to the photoconductive members 12A, 12B, 12C, and 12D from the opening, as shown in FIG. 6.

The developing roller 19 includes a developing sleeve and a magnet roller that generates a magnetic field. The developing sleeve can be made of non-magnetic material, and can carry a developer on a surface of the developing sleeve, wherein the developer includes toners and magnetic carrier.

Each of the developing units 14A, 14B, 14C, and 14D includes a doctor blade 23 that regulates an amount of developer carried on the developing roller 19.

As shown in FIG. 6, a magnetic permeability sensor is provided on the casing 22 to detect a toner concentration in the two-component developer in the developing unit 14, wherein the magnetic permeability sensor faces the transport screw 21A via the casing 22, for example.

Figure 10:
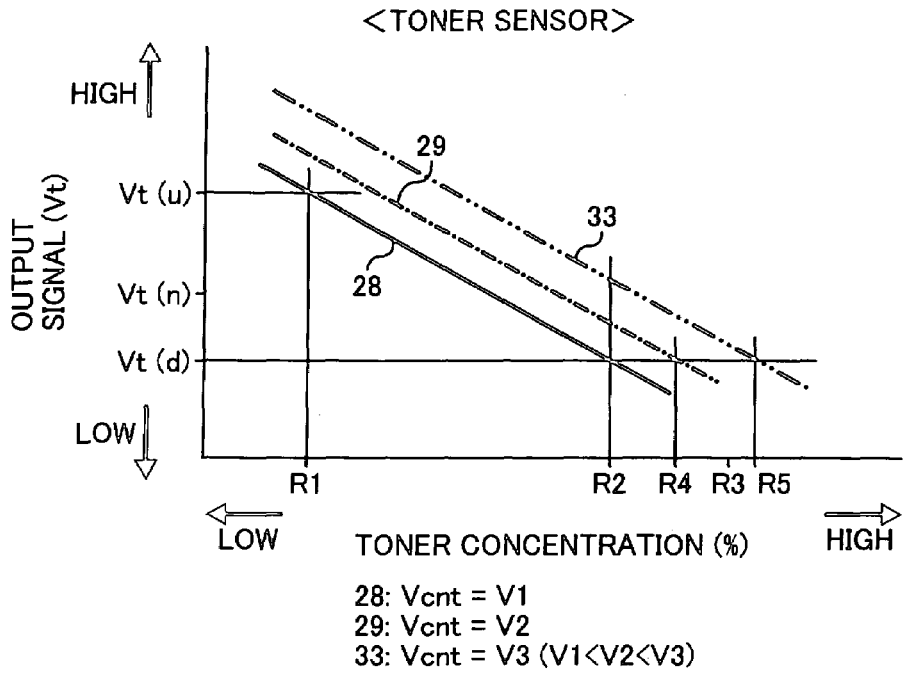
FIG. 10 is a schematic characteristic profile of toner sensor.

Hereinafter, the magnetic permeability sensor is referred to as a toner sensor T24, which is used for detecting a toner concentration in the two-component developer in the developing unit 14. The toner sensor T24 is explained later with FIG. 10 showing a characteristic profile of the output signals of the toner sensor T24.

A toner bottle 26 shown in FIG. 6 contains fresh toner and supplies toner in the developing init 14 as required.

When the image forming apparatus 110 is activated for an image forming operation, each of the photoconductive members 12A, 12B, 12C, and 12D rotates in the clockwise direction in FIG. 5, and the charge roller 17 charges the surface of photoconductive members 12A, 12B, 12C, and 12D uniformly. The optical writing unit 15 irradiates a laser beam Lb to the charged surface of photoconductive members 12A, 12B, 12C, and 12D to write a latent image for each color. Then, the latent image on each of the photoconductive members 12A, 12B, 12C, and 12D comes to a position facing the developing units 14A, 14B, 14C, and 14D with a rotation of the photoconductive members 12A, 12B, 12C, and 12D. Each of the developing units 14A, 14B, 14C, and 14D develops the latent image as a toner image with magenta toner, cyan toner, yellow toner, and black toner, respectively.

The recording sheet P can be transported on the transfer belt 13 as shown in FIG. 5. The toner images of magenta, cyan, yellow, and black are sequentially transferred to the recording sheet P from the developing units 14A, 14B, 14C, and 14D. When the recording sheet P passes the photoconductive member 12D, a full color image having four toner images can be formed on the recording sheet P. Then, the recording sheet P is fed to the fixing unit 18 to melt and fix the toner image on the recording sheet P with heat and pressure. Then, the recording sheet P is ejected to an ejection tray 26 via an ejection roller 25.

Figure 7:
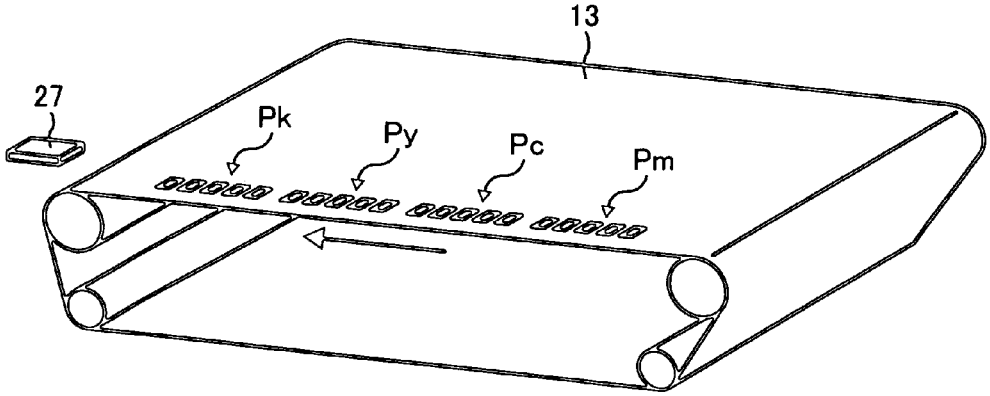
FIG. 7 is a schematic perspective view of a transfer belt of an image forming apparatus and image patterns on a transfer belt.

As shown in FIGS. 5 and 7, a photosensor is provided over a surface of the transfer belt 13. Hereinafter, the photosensor is referred as photosensor P27. The photosensor P27 functions as an image density detector, which detects image density of a developed toner image pattern (hereinafter referred as detection pattern) on the transfer belt 13.

The detection pattern can be formed by developing a latent image on the photoconductive members 12A, 12B, 12C, and 12D by applying a predetermined reference voltage with the developing units 14A, 14B, 14C, and 14D.

An amount of toner to be consumed in the developing units 14A, 14B, 14C, and 14D corresponds to an image area ratio formed on a recording sheet. The image area ratio formed on the recording sheet can be determined from image data.

When the toners in the developing units 14A, 14B, 14C, and 14D are consumed, toners can be refilled into the developing units 14A, 14B, 14C, and 14D to maintain the amount of toners in the developing units 14A, 14B, 14C, and 14D at a predetermined level.

An amount of toner to be refilled into the developing units 14A, 14B, 14C, and 14D can be determined based on the image area ratio formed on the recording sheet and an output signal of toner sensor T24.

As shown in FIG. 7, a plurality of detection patterns Pm, Pc, Py, and Pk can be formed on the transfer belt 13, wherein the detection patterns Pm, Pc, Py, and Pk correspond to magenta, cyan, yellow, and black images, respectively.

The photosensor P27 can detect an image density of the detection patterns Pm, Pc, Py, and Pk, and the photosensor P27 outputs output signals, corresponding to the image density of the detection patterns Pm, Pc, Py, and Pk, to a central processing unit (not shown).

With such a configuration, the image forming apparatus 110 can be set with an image forming mode having preferable image density, charge voltage, light intensity of optical writing unit 15, and output signals of the toner sensor T24.

With such a configuration, a process control for adjusting an image density and toner concentration can be conducted at any timing, as required. Because an image forming operation needs to be interrupted during the process control, such process control is conducted at a predetermined timing considering a productivity of the image forming apparatus 110. For example, the process control may be conducted every five sheets, every ten sheets, or every two hundred sheets.

The image forming apparatus 110 employs the photosensor P27 for detecting image density of the detection pattern, as above-mentioned.

In the image forming apparatus 110, the optical writing unit 15 writes a latent image on the photoconductive member 12, and the developing units 14A, 14B, 14C, and 14D develop the latent image by applying a predetermined reference voltage. As shown in FIG. 7, the detection patterns Pm, Pc, Py, and Pk are formed on the transfer belt 13.

The photosensor P27 includes a light emitting element (not shown) and a light receiving element (not shown), wherein the light receiving element receives light reflected from the detection patterns Pm, Pc, Py, and Pk.

Figure 9:
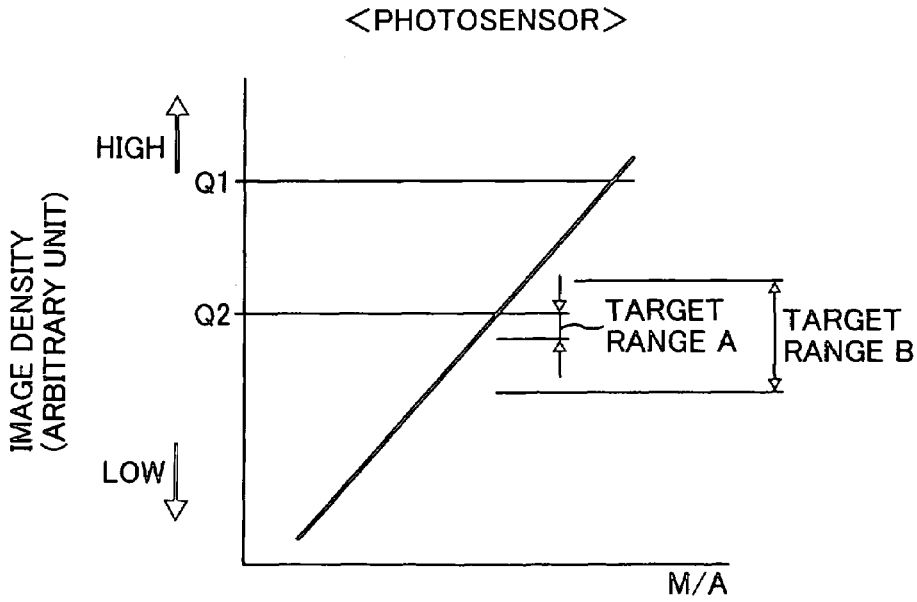
FIG. 9 is a schematic characteristic profile of photosensor.

The photosensor P27 outputs an output signal Vsp, corresponding to reflected light from each of the detection patterns Pm, Pc, Py, and Pk, and an output signal Vsg, corresponding to reflected light from a background area of the transfer belt 13. FIG. 9, to be explained later, shows a characteristic profile of image density detected by the photosensor P27.

Figure 8:
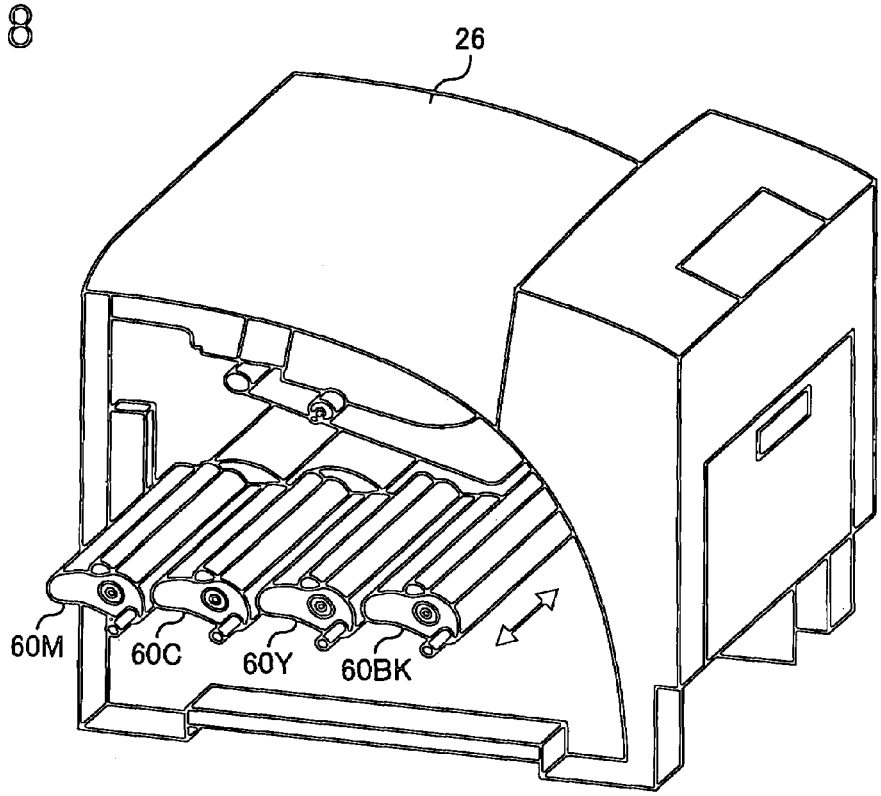
FIG. 8 is a schematic perspective view of an image forming apparatus having a process cartridge.

The image forming apparatus 110 shown in FIGS. 5 to 7 has an internal configuration as shown in FIG. 8. The image forming apparatus 110 includes process cartridges 60M, 60C, 60Y, and 60K for each color. The process cartridges 60M, 60C, 60Y, and 60K are detachable from the image forming apparatus 110, as shown in FIG. 8.

The process cartridge 60M can integrate the photoconductive member 12A, charge roller 17, and developing unit 14A as one unit. The process cartridge 60C can integrate the photoconductive member 12B, charge roller 17, and developing unit 14B as one unit. The process cartridge 60Y can integrate the photoconductive member 12C, charge roller 17, and developing unit 14C as one unit. The process cartridge 60K can integrate the photoconductive member 12D, charge roller 17, and developing unit 14D as one unit.

Each of the process cartridges 60M, 60C, 60Y, and 60K can integrate at least two of the photoconductive member 12, charge roller 17, and developing unit 14 as one unit. Each of the process cartridges 60M, 60C, 60Y, and 60K integrates several components as one unit by using the casing 22 shown in FIG. 6, for example. The above-mentioned process cartridges 60M, 60C, 60Y, and 60K can improve the efficiency of maintenance work for the image forming apparatus 110.

Hereinafter, a method of controlling a toner concentration and image density for the image forming apparatus 110 is explained in detail, wherein such control can typically suppress a significant increase of toner concentration and a significant decrease of image density when producing a smaller image area with the image forming apparatus 110.

In an example embodiment, the image forming apparatus 110 is set with a target voltage Vref having a predetermined range (hereinafter, Vref range), wherein the target voltage Vref is a parameter to control a toner concentration in the developing unit 14 within a predetermined range (i.e., Vref range), which is set for the image forming apparatus 110 as a design value in advance considering image forming conditions for the image forming apparatus 110. The target voltage Vref and the Vref range can be changed, as required, by considering image forming conditions.

The Vref range includes an upper and lower limit voltage (to be described later).

Furthermore, in an example embodiment, a toner concentration range (hereinafter referred as a TC range, as required) in the developing unit 14 is related to the Vref range, which will be described later.

Based on the target voltage Vref (and Vref range), the image forming apparatus 110 can control a toner concentration in the developing unit 14 at a predetermined level, and the toner sensor T24 outputs an output signal Vt corresponding to an actual toner concentration in the developing unit 14.

Accordingly, the toner concentration in the developing unit 14 is controlled by the Vref (and Vref range), and the output signal Vt of the toner sensor T24 is resultant information of toner concentration in the developing unit 14. As described later, the toner concentration in the developing unit 14 is controlled by referring to an image density of a detection pattern detected by the photosensor P27.

FIG. 9 shows a characteristic profile of image density detected by the photosensor P27. The vertical axis represents an image density of detection pattern, and the horizontal axis represents a toner mass per unit area (MIA) of the detection pattern.

The image density on the vertical axis is computed from output signals of the photosensor P27, and thereby the image density on the vertical axis is expressed with an arbitrary unit for image density.

For example, an arbitrary unit Q1 shown in FIG. 9 represents the highest image density of solid image of detection pattern, and an arbitrary unit Q2 represents a standard image density for detection pattern, which can be preferably used for image forming operations.

As shown in FIG. 9, a first target range (hereinafter, referred as target range A) including the arbitrary unit Q2 is set for the image forming apparatus 110, and a second target range (hereinafter, referred as target range B) including the arbitrary unit Q2 is set for the image forming apparatus 110, wherein the target range B has a broader range compared to the target range A.

The image forming apparatus 110 can produce a high quality image when images are produced with the target range A, and can produce a sub-high quality image when images are produced with the target range B.

Image quality produced with the target range B may be relatively lower compared to the target range A, but such image quality produced within the target range B can be practically an allowable level (e.g., a user may satisfy an image quality produced with the target range B).

The target ranges A and B can be adjusted to any range based on image forming conditions; such as types of image forming apparatus, and types of developer, for example.

FIG. 10 shows a characteristic profile of output signals of the toner sensor T24. The vertical axis represents an output signal of the toner sensor T24, and the horizontal axis represents a toner concentration percent (%) in the developing unit 14.

The characteristic profile of the toner sensor T24 can be changed by changing a sensor control voltage Vcnt, which is set for image forming apparatus 110 in advance.

For example, the toner sensor T24 has a profile 28 when the sensor control voltage Vcnt is set to V1 voltage. Such profile 28 of the toner sensor T24 can be shifted to a profile 29 in a parallel manner by changing the sensor control voltage Vcnt from V1 voltage to V2 voltage, wherein V2 voltage is larger than V1 voltage.

Hereinafter, a control system for controlling a toner concentration is explained with reference to FIGS. 9 to 12.

Figure 11:
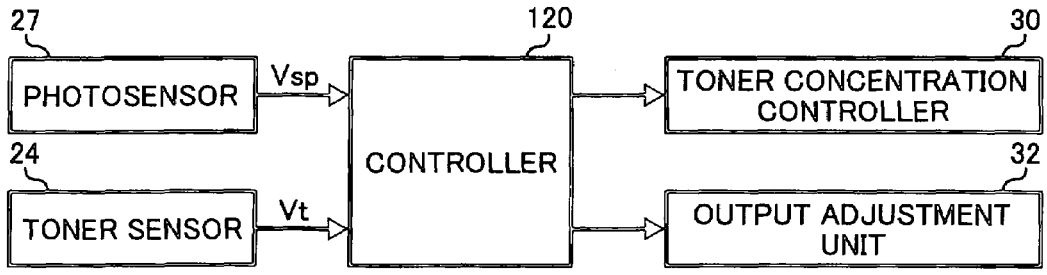
FIG. 11 is a schematic block diagram of a control system for controlling a toner concentration.

As shown in FIG. 11, the image forming apparatus 110 includes the controller 120. The controller 120 is coupled to the photosensor P27 and toner sensor T24. The controller 120 receives an output signal Vsp from the photosensor P27 and an output signal Vt from the toner sensor T24. The controller 120 controls the toner concentration controller 30 based on the output signals Vsp and Vt. Then, the toner concentration controller 30 controls a toner concentration in the developing unit 14.

Furthermore, the controller 120 controls the output adjustment unit 32, wherein the output adjustment unit 32 can adjust a characteristic (e.g., toner concentration sensing level) of the toner sensor T24 with a sensor control voltage Vcnt.

For example, by changing the sensor control voltage Vcnt from V1 voltage to V2 voltage (e.g., V1<V2), the characteristic profile of the toner sensor T24 can be changed from the profile 28 to the profile 29, as shown in FIG. 10.

The toner concentration controller 30 controls a toner concentration in the developing unit 14 based on the output signal Vt of the toner sensor T24 and with the target voltage Vref (and Vref range).

In an example embodiment, the toner sensor T24 has the profile 28 by setting the sensor control voltage Vcnt to V1 voltage, and the target voltage Vref (and Vref range) for controlling toner concentration corresponds to a toner concentration range of R1 to R2 shown in FIG. 10.

As a default condition of the image forming apparatus 110, the profile 28 of the toner sensor T24 corresponds to the target range A of the photosensor 27.

If the toner sensor T24 has the profile 28 set by the sensor control voltage Vcnt of V1 voltage, the output signal Vt of the toner sensor T24 corresponds to a range of Vt(u) to Vt(d) shown in FIG. 10, wherein Vt(u) corresponds to a lower limit of toner concentration R1 and Vt(d) corresponds to an upper limit of toner concentration R2, as shown in FIG. 10.

Accordingly, the toner sensor T24 can function as a toner sensor only in the range of Vt(u) to Vt(d) when the sensor control voltage Vcnt is set to V1 voltage.

If an image forming operation is conducted in the image forming apparatus 110 with only setting the target range A, a following drawback may occur.

When the image forming apparatus 110 continuously produces a smaller image area on a recording medium, a frequency of refilling fresh toner into the developing unit becomes smaller, by which a charging potential of toner in the developing unit 14 may increase.

An increased charging potential of toner may downgrade developability of toner, and the downgraded developability of toner may cause a lower image density. Accordingly, the image density of detection pattern detected by the photosensor P27 may become smaller than a lower limit of the target range A.

When the image density of a detection pattern detected by the photosensor P27 becomes smaller than a lower limit of the target range A, the target voltage Vref may be changed within the Vref range to increase the toner concentration in the developing unit 14.

If such image density, which becomes smaller than the lower limit of the target range A, can be adjusted in the target range A by changing the target voltage Vref within the Vref range, the image forming apparatus 110 can produce a high quality image.

However, if such image density, which becomes smaller than the lower limit of the target range A, cannot be adjusted in the target range A by changing the target voltage Vref within the Vref range, the target voltage Vref may be changed beyond the Vref range so that the image density, which becomes smaller than a lower limit of the target range A, can be adjusted in the target range A.

By changing the target voltage Vref in such manner, a toner concentration in the developing unit 14 may be increased (i.e., an output signal Vt of the toner sensor T24 may be decreased).

However, even if the Vref can be changed beyond the Vref range, the output signal Vt of the toner sensor T24 cannot be made smaller than Vt(d) (i.e., lower limit of the profile 28) because of the characteristic of the toner sensor T24. (As above mentioned, the toner sensor T24 can function as a toner sensor only in the range of Vt(u) to Vt(d) when the sensor control voltage Vcnt is set to V1 voltage.)

Accordingly, the toner concentration in the developing unit 14 cannot be increased to a level larger than the toner concentration R2, which corresponds to the Vt(d) shown in FIG. 10. Therefore, an image density to be produced on a recording medium may become lower, which is not practically allowable for image quality.

Similarly, if an image forming operation is conducted in the image forming apparatus 110 with setting the target range A and Vcnt-changing function, a following drawback may occur.

When the image forming apparatus 110 continuously produces smaller a image area on a recording medium, a frequency of refilling fresh toner into the developing unit becomes smaller, by which a charging potential of toner in the developing unit 14 may increase.

An increased charging potential of toner may downgrade developability of toner, and the downgraded developability of toner may cause a lower image density. Accordingly, the image density of detection pattern detected by the photosensor P27 may become smaller than a lower limit of the target range A.

When the image density of a detection pattern detected by the photosensor P27 becomes smaller than the lower limit of the target range A, the target voltage Vref may be changed within the Vref range to increase the toner concentration in the developing unit 14.

If such image density, which becomes smaller than the lower limit of the target range A, can be adjusted in the target range A by changing the target voltage Vref within the Vref range, the image forming apparatus 110 can produce a high quality image.

However, if such image density, which becomes smaller than the lower limit of the target range A, cannot be adjusted in the target range A by changing the target voltage Vref within the Vref range, the target voltage Vref may be changed beyond the Vref range so that the image density, which becomes smaller than the lower limit of the target range A, can be adjusted in the target range A.

By changing the target voltage Vref in such a manner, a toner concentration in the developing unit 14 may be increased (i.e., an output signal Vt of the toner sensor T24 may be decreased).

However, even if the Vref can be changed beyond the Vref range, the output signal Vt of the toner sensor T24 cannot be made smaller than Vt(d) (i.e., lower limit of the profile 28) because of the characteristic of the toner sensor T24. (As above mentioned, the toner sensor T24 can function as a toner sensor only in the range of Vt(u) to Vt(d) when the sensor control voltage Vcnt is set to V1 voltage.)

Accordingly, the toner concentration in the developing unit 14 cannot be increased to a level larger than the toner concentration R2, which corresponds to the Vt(d) shown in FIG. 10. Therefore, an image density to be produced on recording medium may become lower, which is not practically allowable for image quality.

In such a case, the sensor control voltage Vcnt can be changed to V3 voltage from V1 voltage, for example, so that the profile 28 of the toner sensor T24 can be shifted to a profile 33, as shown in FIG. 10.

With such controlling, an output signal Vt of the toner sensor T24 on the profile 33 becomes greater than the output signal Vt(d) of the toner sensor T24 on the profile 28 when the toner concentration becomes the toner concentration R2 (i.e., upper limit of toner concentration range on the profile 28), as shown in FIG. 10.

Accordingly, a toner concentration range of R1 to R5 corresponding to the profile 33 can be set greater than the toner concentration range R1 to R2 on the profile 28, as shown in FIG. 10.

However, the toner concentration R5 on the profile 33 may exceed the toner concentration R2 on the profile 28 as shown in FIG. 10. If the toner concentration R5 becomes significantly greater than the toner concentration R2, unfavorable phenomenon, such as toner scattering, may occur.

In order to cope with such drawbacks, an example embodiment sets two image density ranges: target range A and target range B, which are mentioned as above.

If the image density of a detection pattern detected by the photosensor P27 becomes a lower limit of the target range A, a target range for the image density is changed to the target range B from the target range A.

In other words, a target range for the image density detected by the photosensor P27 is changed to the target range B from the target range A if the target voltage Vref becomes a lower limit of the Vref range (e.g., Vt(d) on the profile 28 in FIG. 10).

If the image density of a detection pattern can be maintained within the target range B, a toner concentration in the developing unit 14 may not need to be changed.

When the image forming apparatus 110 continuously produces a smaller image area on a recording medium under such a condition, an image density may become a lower limit of the target range B, and eventually may become smaller than a lower limit of the target range B.

If the image density becomes smaller than the lower limit of the target range B, the sensor control voltage Vcnt is changed from V1 voltage to another voltage (e.g., V2 voltage).

The sensor control voltage Vcnt can be changed so that a toner concentration, which corresponds to the output signal Vt(d) of the toner sensor T24, can be set to a desired value such as between the toner concentration R2 and R3, as shown in FIG. 10.

For example, the profile 28 of the toner sensor T24 can be shifted to the profile 29 by changing sensor control voltage Vcnt from V1 voltage to V2 voltage as shown in FIG. 10, and a toner concentration range corresponding to the profile 29 can be set greater compared to the profile 28, as shown in FIG. 10.

Furthermore, a toner concentration on the profile 29 at a lower limit Vt(d) of the toner sensor T24 becomes a toner concentration R4.

Because the toner concentration R4 is smaller than the toner concentration R3, unfavorable phenomenon such as toner scattering can be typically prevented, wherein the unfavorable phenomenon may occur when a toner concentration in the developing unit 14 exceeds the toner concentration R3.

With such controlling, even when the image forming apparatus 110 continuously produces a smaller image area on a recording medium, a significant increase of toner concentration and a significant decrease of image density can be typically prevented simultaneously.

If a central processing unit (not shown) judges that an image density of detection pattern detected by the photosensor P27 is within the target range B after changing the sensor control voltage Vcnt from V1 voltage to V2 voltage, the central processing unit (not shown) decreases the changed Vcnt (e.g., V2) toward a default value of the sensor control voltage Vcnt (e.g., V1) step-wisely.

The central processing unit (not shown) checks a relationship of Vref and Vt as a criterion for decreasing the changed Vcnt step-wisely. Specifically, a value calculated by Vref minus Vt (=Vref−Vt) is used as a criterion for decreasing the changed Vcnt step-wisely. If the "Vref−Vt" becomes greater than a predetermined value, the changed Vcnt is decreased step-wisely.

With such controlling, the image forming apparatus 110 can approximate the changed Vcnt to the default value of sensor control voltage Vcnt. Such control on the changed Vcnt is preferably conducted so that the sensor control voltage Vcnt may not deviate from the default value of sensor control voltage Vcnt.

Figures 12, 12A, 12B:
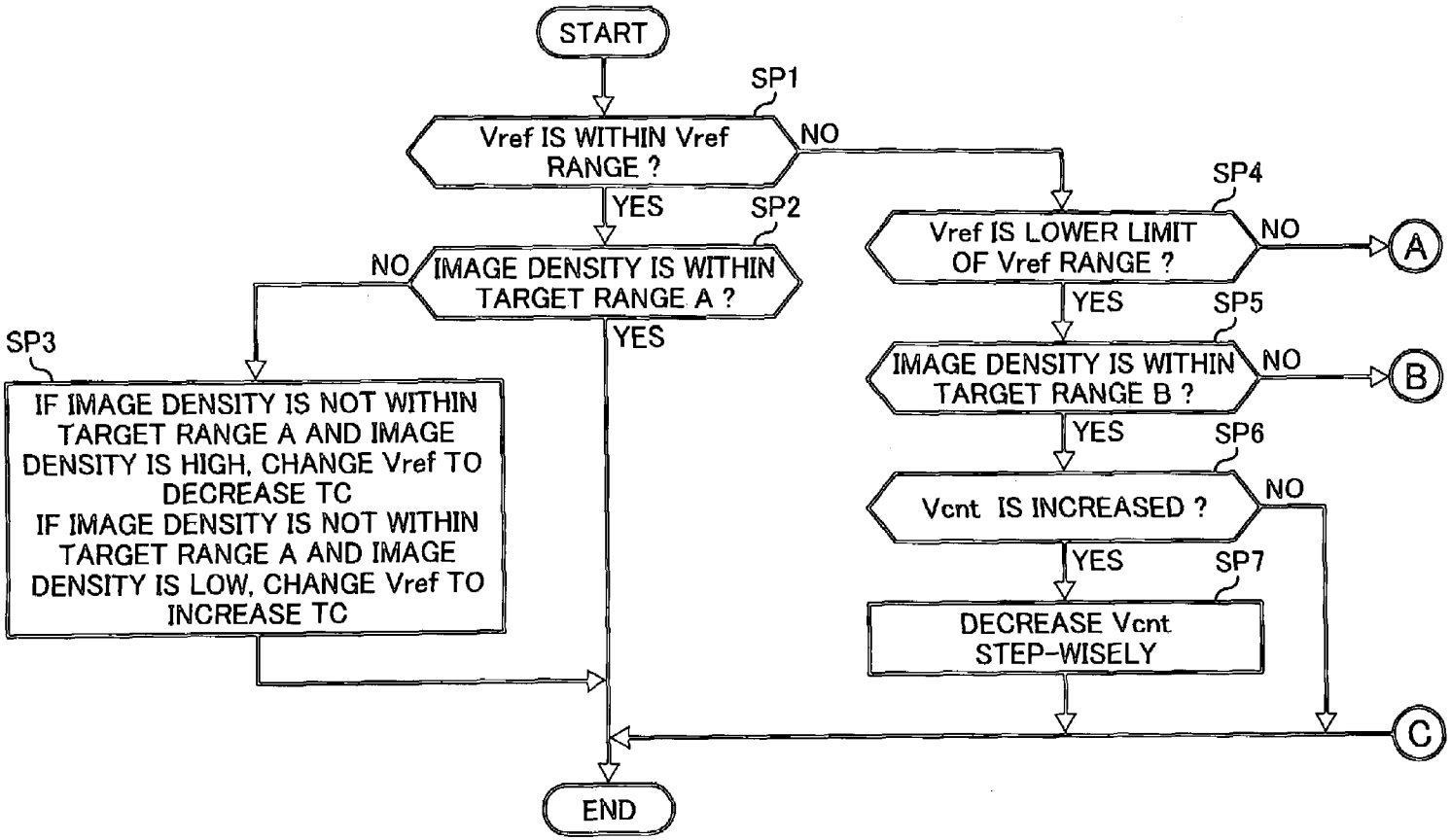
FIGS. 12A and 12B are a flowchart for explaining a process control for image density and toner concentration.
Figure 12B:
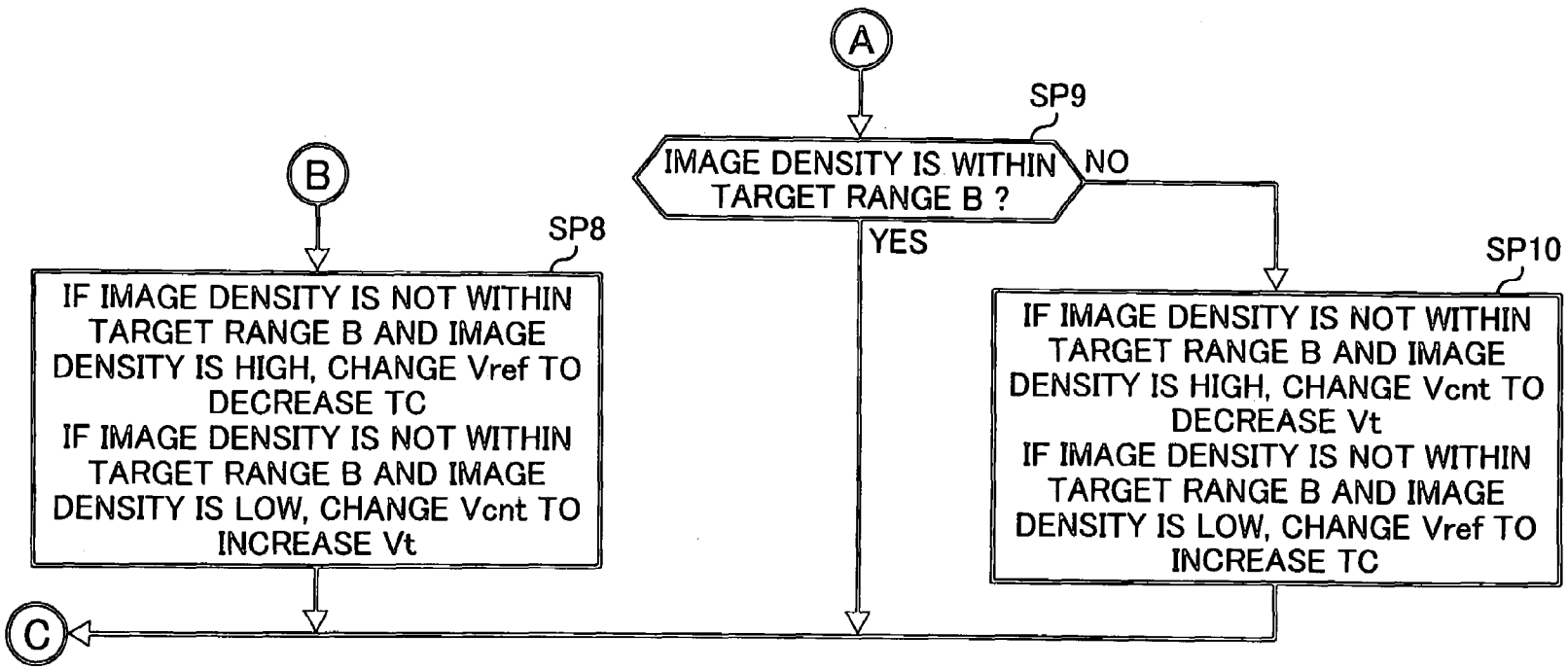

Hereinafter, a process control for image density and toner concentration is explained with a flow chart shown in FIG. 12.

For the sake of explanation, the following conditions are set as one example: a sensor control voltage Vcnt is set to V1 voltage as a default value; an upper limit of Vt(n) is set to Vt(u)=4.0V; a lower limit of Vt(n) is set to Vt(d)=2.0V; and a Vref range is set from 2.0V to 4.0V. In FIG. 12, for simplifying the term, toner concentration is abbreviated as "TC."

In step SP1, a central processing unit CPU (not shown) judges whether the target voltage Vref is within the Vref range (e.g., greater than 2.0V and less than 4.0V).

If the CPU judges that the target voltage Vref is within the Vref range (e.g., greater than 2.0V and less than 4.0V) in step SP1, the process goes to step SP2.

If CPU judges that the target voltage Vref becomes an upper limit (e.g., 4.0V) or a lower limit (e.g., 2.0V) of the Vref range in step SP1, the process goes to step SP4.

In step SP2, the CPU judges whether an image density of detection pattern detected by the photosensor P27 is within the target range A.

If the CPU judges that the image density of detection pattern detected by the photosensor P27 is within the target range A in step SP2, the CPU completes the process.

If the CPU judges that the image density of detection pattern detected by the photosensor P27 is not within the target range A in step SP2, the process goes to step SP3.

If the image density of detection pattern detected by the photosensor P27 is not within the target range A and an image density of detection pattern is higher than the target range A, the target voltage Vref is changed to decrease a toner concentration in the developing unit 14 in step SP3, and the process completes.

If the image density of detection pattern detected by the photosensor P27 is not within the target range A and an image density of detection pattern is lower than the target range A, the target voltage Vref is changed to increase a toner concentration in the developing unit 14 in step SP3, and the process completes.

A process flow consisting of steps SP1 and SP2 and a process flow consisting of steps SP1, SP2, and SP3 are conventionally conducted for an image forming apparatus.

In step SP4, the CPU judges whether the target voltage Vref becomes a lower limit of the Vref range, wherein the lower limit of the Vref range corresponds to an upper limit of toner concentration range (TC range).

For example, if the Vref range is from 2.0V to 4.0V as above mentioned, the CPU (not shown) judges whether the target voltage Vref becomes 2.0V (i.e., lower limit of Vref range).

If the target voltage Vref becomes the lower limit of Vref range (e.g., 2.0V), the CPU selects the target range B for image density to be detected by the photosensor P27, and the process goes to step SP5.

In step SP5, the CPU judges whether an image density of detection pattern detected by the photosensor P27 is within the target range B.

If the CPU judges that the image density of detection pattern detected by the photosensor P27 is within the target range B in step SP5, the process goes to step SP6.

In step S6, the CPU judges whether the sensor control voltage Vcnt is increased from a default value (i.e., changed Vcnt>default Vcnt).

If the CPU judges that the sensor control voltage Vcnt is increased from a default value (i.e., changed Vcnt>default Vcnt), the process goes to step SP7.

In step S7, the changed Vcnt is decreased step-wisely toward the default Vcnt to maintain a difference of Vref and Vt (=Vref−Vt) at a desired level. For example, the difference of Vref and Vt (=Vref−Vt) may be set to a value smaller than 0.1V (i.e., Vref−Vt≦0.1).

Step S7 is conducted to make the changed Vcnt toward a smaller value (i.e., default Vcnt) as much as possible if the image density of detection pattern detected by the photosensor P27 is within the target range B. Such control on the sensor control voltage Vcnt is preferably conducted so that the sensor control voltage Vcnt may not deviate from the default value.

With such a step S7, a significant increase of toner concentration in the developing unit 14 can be typically suppressed so that unfavorable phenomenon, such as toner scattering, can be typically suppressed.

If the CPU judges that the image density of the detection pattern detected by the photosensor P27 is not within the target range B in step SP5, the process goes to step SP8.

If the image density of detection pattern detected by the photosensor P27 is not within the target range B and an image density of detection pattern is higher than the target range B, the target voltage Vref is changed to decrease a toner concentration in the developing unit 14.

If the image density of detection pattern detected by the photosensor P27 is not within the target range B and an image density of detection pattern is lower than the target range B, the sensor control voltage Vcnt is changed to change a toner concentration sensing level of the toner sensor T24 so that an output signal Vt of the toner sensor T24 can be increased from one level to another level (e.g., from profile 28 to profile 29 in FIG. 10). By increasing the level of the output signal Vt of the toner sensor T24, a toner concentration can be adjusted at a further high concentration level (e.g., toner concentration R2 to R4 for profile 29 in FIG. 10).

Accordingly, when the target voltage Vref becomes a lower limit of the Vref range (i.e., upper limit of the toner concentration range) and the image density of detection pattern detected by the photosensor P27 becomes smaller than the lower limit of the target range B, a change of the sensor control voltage Vcnt is allowed.

If the CPU judges that the target voltage Vref is not a lower limit (e.g., 2.0V) of the Vref range in step SP4, the process goes to step SP9. In this case, the CPU judges that the target voltage Vref is an upper limit (e.g., 4.0V) of the Vref range (i.e., lower limit of toner concentration range).

In step SP9, the CPU judges whether the image density of the detection pattern detected by the photosensor P27 is within the target range B.

If the CPU judges that the image density of detection pattern detected by the photosensor P27 is not within the target range B in step SP9, the process goes to step S10.

If an image density of detection pattern detected by the photosensor P27 is not within the target range B and an image density of detection pattern is higher than the target range B, the sensor control voltage Vcnt is changed to decrease an output signal Vt of the toner sensor T24 in step SP10 (e.g., from profile 29 to profile 28 in FIG. 10).

If an image density of detection pattern detected by the photosensor P27 is not within the target range B and an image density of detection pattern is lower than the target range B, the target voltage Vref is changed to increase a toner concentration in the developing unit 14 in step SP10.

In the above explained example embodiment, the CPU changes the target voltage Vref within the Vref range to adjust the image density of detection pattern in the target range A.

However, if the target voltage Vref becomes a lower limit of the Vref range (i.e., upper limit of toner concentration range), the CPU cannot further decrease the target voltage Vref because of a characteristic of the toner senor T24.

If the sensor control voltage Vcnt is changed freely under such condition while only setting the target range A, a toner concentration in the developing unit 14 may be unpreferably increased, which may cause unfavorable phenomenon such as toner scattering and fogging.

In the above-explained example embodiment, the target range B is set in addition to the target range A in order to cope with such drawback.

Accordingly, as above-described, the sensor control voltage Vcnt is changed to increase a toner concentration range when the target voltage Vref becomes a lower limit of the Vref range and the image density of detection pattern detected by the photosensor P27 becomes smaller than a lower limit of target range B.

The image forming apparatus 110 conducts the above-described controlling, by which a significant increase of toner concentration and a significant decease of image density can be typically prevented simultaneously.

In the above-described example embodiment, the image forming apparatus 110 is explained with one example configuration, but other configuration can be used. For example, numerical values used in the above description can be changed to other values, as required. Specifically, a size and number of the detection patterns can be changed within the spirit and scope of the present disclosure. Furthermore, instead of a phototransistor, a photo-diode and a charge coupled device (CCD) can be used as a density sensor, for example. Furthermore, the above-described process control for image density and toner concentration can be conducted upon a request of a user.

Figure 13:
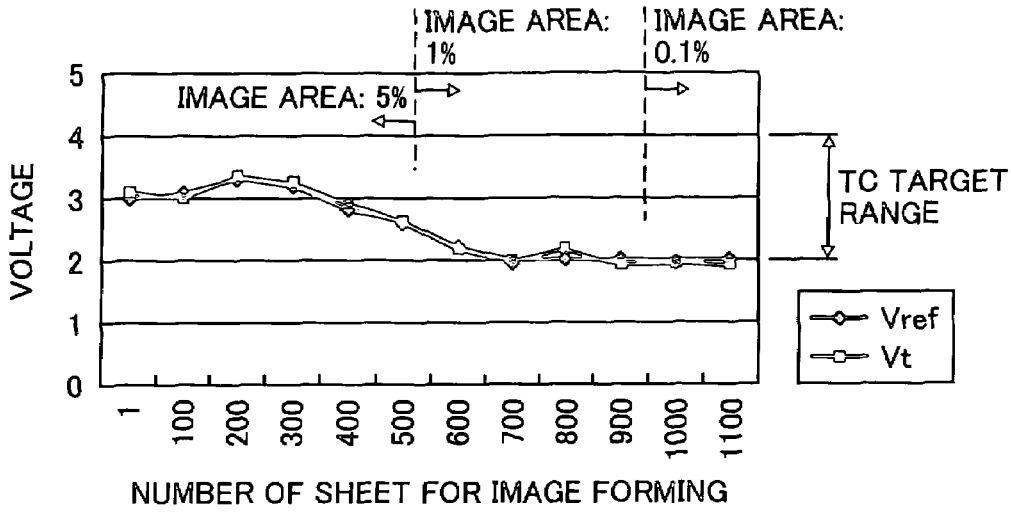
FIG. 13 is an example graph showing a change of output signal of a photosensor when an image area is changed.

FIG. 13 shows a change of target voltage Vref when an image area produced by the image forming apparatus 110 is changed. The vertical axis represents a target voltage Vref and output signal Vt of the toner sensor T24, and the horizontal axis represents a number of sheets used for image printing.

As shown in FIG. 13, when an image area ratio is 5%, the target voltage Vref and output signal Vt are controlled within a Vref range (i.e., TC target range). When an image area ratio becomes 1%, the target voltage Vref and output signal Vt gradually become closer to a lower limit of the Vref range, and becomes the lower limit of the Vref ranger when a number of sheets used for image printing becomes 700 or more. When an image area ratio becomes 0.1%, the target voltage Vref and output signal Vt becomes the lower limit of the Vref range.

FIG. 13 shows only one example, and if conditions (e.g., developer condition, a number of sheets used for image printing, or the like) are changed, the target voltage Vref and output signal Vt may change in a different pattern.

Figure 14:
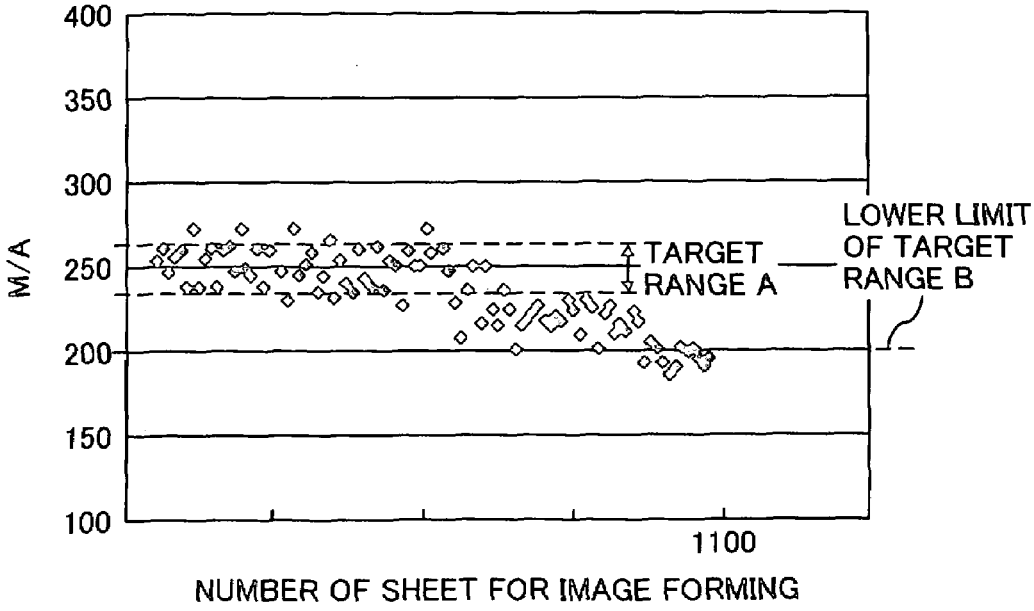
FIG. 14 is an example graph showing a change of image density.

FIG. 14 shows data of image density of detection pattern detected by the photosensor P27, in which the image density detected by the photosensor P27 is converted to toner mass per unit area (M/A). The vertical axis represents the toner mass per unit area (M/A), and the horizontal axis represents a number of sheets used for image printing, corresponded to the horizontal axis in FIG. 13.

By conducting the above explained process control, the image density of detection pattern detected by the photosensor P27 can be controlled within the target range A when the target voltage Vref is controlled within the Vref range. Therefore, most of the data are within the target range A, as shown in FIG. 14.

When the target voltage Vref becomes a lower limit of the Vref range (e.g., when a number of sheets used for image printing becomes 700 or more as shown in FIG. 13), the image density of detection pattern detected by the photosensor P27 is then controlled within the target range B.

If the image density of detection pattern detected by the photosensor P27 becomes smaller than a lower limit of target range B, the sensor control voltage Vcnt is changed (see FIG. 15) to increase a toner concentration in the developing unit 14.

Figure 15:
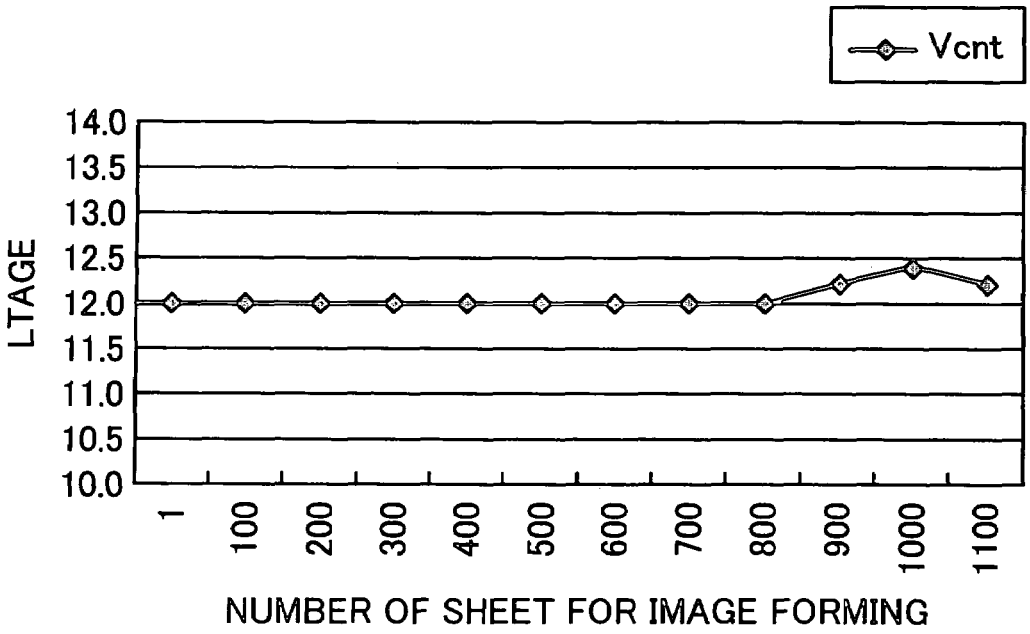
FIG. 15 is an example graph showing a change of control signal of a toner sensor.

FIG. 15 is a graph for explaining a change of sensor control voltage Vcnt of the toner sensor T24. The vertical axis represents a sensor control voltage Vcnt, and the horizontal axis represents a number of sheets used for image forming, corresponded to the horizontal axis in FIGS. 13 and 14.

When the target voltage Vref becomes a lower limit of the Vref range and the image density of detection pattern detected by the photosensor P27 becomes smaller than a lower limit of target range B, the sensor control voltage Vcnt is changed.

In case of FIG. 15, the following control is repeatedly conducted: if the image density of detection pattern detected by the photosensor P27 remains within the target range B, the sensor control voltage Vcnt is changed to a lower value, and if the image density of detection pattern detected by the photosensor P27 becomes smaller than a lower limit of target range B, the sensor control voltage Vcnt is changed to a higher value.

As shown in FIG. 15, the sensor control voltage Vcnt is changed to a higher or lower value when the number of sheets used for image forming becomes around 1,000 (i.e., the target voltage Vref becomes a lower limit of the Vref range).

Numerous additional modifications and variations are possible in light of the above teachings. It is therefore to be understood that within the scope of the appended claims, the disclosure of the present invention may be practiced otherwise than as specifically described herein.

The invention claimed is:

1. An image forming apparatus, comprising:

an image carrying member configured to form a reference latent image pattern thereon;

a developing unit configured to develop the reference latent image pattern as a reference image pattern with a two-component developer having toner and a carrier;

an image density detector configured to detect an image density of the reference image pattern;

a toner concentration detector configured to detect a toner concentration in the two-component developer;

a toner concentration controller configured to control the toner concentration in the two-component developer based on the image density detected by the image density detector;

an output adjustment unit configured to adjust a toner concentration sensing level of the toner concentration detector with a sensor control voltage; and a controller configured to control the toner concentration in the two-component developer by changing a target voltage based on the image density detected by the image density detector, the target voltage being set in advance for regulating the toner concentration in the two-component developer and having a corresponding voltage range for changing the target voltage, wherein the controller is configured to control the toner concentration in the two-component developer in a first toner concentration range having an upper and lower limit by changing the target voltage in the voltage range, and when the toner concentration becomes one of the upper and lower limit of the first toner concentration range, a second toner concentration range, which is broader than the first toner concentration range, is set for the toner concentration range by changing the sensor control voltage so that the toner concentration is controlled in the second toner concentration range.

2. The image forming apparatus according to claim 1, wherein the first and second toner concentration ranges correspond to output signals of the toner concentration detector, and the second toner concentration range is provided to control a toner concentration in the two-component developer at a level greater than the upper limit of the first toner concentration range.

3. The image forming apparatus according to claim 1, wherein the controller is configured to control the sensor control voltage based on a first and second target range for the image density, wherein the first target range includes an image density of high quality and the second target range includes an image density of sub-high quality having an allowable lower quality compared to the first target range, and wherein the image forming apparatus produces images within the first and second target ranges.

4. The image forming apparatus according to claim 3, wherein, when an output signal of the toner concentration detector becomes the upper limit of the first toner concentration range and an image density detected by the image density detector becomes smaller than a lower limit of the second target range for the image density, the controller is configured to change the sensor control voltage to change a toner concentration sensing level of the toner concentration detector.

5. The image forming apparatus according to claim 3, wherein, when an image density detected by the image density detector remains within the second target range of the image density after changing a toner concentration sensing level of the toner concentration detector by changing the sensor control voltage from a first voltage to a second voltage, the controller is configured to step-wisely change the sensor control voltage from the second voltage toward the first voltage.

6. The image forming apparatus according to claim 1, further comprising:

a process cartridge configured to integrate at least the image carrying member and the developing unit, and wherein the process cartridge is detachable from the image forming apparatus.

* * * * *